US005178117A

United States Patent [19]

Fujimoto et al.

[11] Patent Number: 5,178,117

[45] Date of Patent: Jan. 12, 1993

[54] EVAPORATIVE FUEL-PURGING CONTROL SYSTEM FOR INTERNAL COMBUSTION ENGINES

[75] Inventors: Sachito Fujimoto; Fumio Hosoda; Masakazu Kitamoto, all of Wako, Japan

[73] Assignee: Honda Giken Kogyo Kabushiki Kaisha, Tokyo, Japan

[21] Appl. No.: 884,690

[22] Filed: May 18, 1992

[30] Foreign Application Priority Data

Jun. 21, 1991 [JP] Japan ..... 3-177490

[51] Int. Cl.[5] ..... F02M 33/02

[52] U.S. Cl. ..... 123/520; 123/198 D; 123/519; 123/518

[58] Field of Search ..... 123/516, 518, 519, 520, 123/521, 198 D, 494

[56] References Cited

U.S. PATENT DOCUMENTS

| | | | |
|---|---|---|---|
| 4,862,856 | 9/1989 | Yokoe et al. | 123/520 |
| 4,867,126 | 9/1989 | Yonekawa et al. | 123/520 |
| 4,913,121 | 4/1990 | Shimomura et al. | 123/520 |
| 4,942,860 | 7/1990 | Chujo et al. | 123/494 |
| 4,945,885 | 8/1990 | Gonze et al. | 123/520 |
| 4,949,695 | 8/1990 | Uranishi et al. | 123/520 |
| 4,962,744 | 10/1990 | Uranishi et al. | 123/520 |
| 5,048,493 | 9/1991 | Orzel et al. | 123/520 |
| 5,085,194 | 2/1992 | Kuroda et al. | 123/520 |
| 5,085,197 | 2/1992 | Mader et al. | 123/520 |
| 5,111,796 | 5/1992 | Ogita | 123/520 |

*Primary Examiner*—E. Rollins Cross
*Assistant Examiner*—Thomas Moulis
*Attorney, Agent, or Firm*—Nikaido, Marmelstein, Murray & Oram

[57] ABSTRACT

An evaporative fuel-purging control system for an internal combustion engine comprises a mass flowmeter and a differential pressure type flowmeter arranged in a purging passage of the engine for measuring a flow rate of a mixture of evaporative fuel and air being purged. The flowmeters have different output characteristics relative to change in the concentration of evaporative fuel in the mixture from each other. Output values from the flowmeters are compared to obtain a difference or a ratio therebetween. Failure of at least one of the flowmeters is detected based upon the difference or the ratio.

8 Claims, 7 Drawing Sheets

EVAPORATIVE FUEL-PURGING CONTROL SYSTEM FOR INTERNAL COMBUSTION ENGINES

BACKGROUND OF THE INVENTION

1. Field of the Invention

This invention relates to an evaporative fuel-purging control system for an internal combustion engine having an evaporative emission control system.

2. Prior Art

Conventionally, evaporative emission control systems have been widely used in internal combustion engines, which operate to prevent evaporative fuel (fuel vapor) from being emitted from a fuel tank into the atmosphere, by temporarily storing evaporative fuel from the fuel tank in a canister, and purging same into the intake system of the engine. Purging of evaporative fuel into the intake system causes instantaneous enriching of an air-fuel mixture supplied to the engine. If the purged evaporative fuel amount is small, the air-fuel ratio of the mixture will then be promptly returned to a desired value, with almost no fluctuation.

However, if the purged evaporative fuel-purging amount is large, the air-fuel ratio of the mixture fluctuates. To cope with this, there has been proposed by the assignee of the present invention an evaporative fuel-purging control system which includes a plurality of flowmeters arranged across a purging conduit line connecting between a canister and an intake system of an internal combustion engine and detects a flow rate of a mixture of evaporative fuel and air flowing in the purging conduit line, a flow rate of evaporative fuel, etc., based upon output values of the flowmeters (Japanese Patent Application No. 3-80726).

This proposed system further includes a purge control valve arranged across the purging conduit line, which is driven to control the flow rate of the mixture such that the actual flow rate of evaporative fuel becomes equal to a desired value.

However, if any of the flowmeters becomes defective, the proposed system cannot perform accurate control of the flow rate of evaporative fuel supplied to the engine intake system. For example, an excessive amount of evaporative fuel can be supplied to the intake system, resulting in overriching of the air-fuel ratio. Conversely, an insufficient amount of evaporative fuel can be supplied to the intake system, resulting in overleaning of the air-fuel ratio. This leads to degraded exhaust emission characteristics, etc.

SUMMARY OF THE INVENTION

It is the object of the invention to provide an evaporative fuel-purging control system for internal combustion engines, which has a fault diagnostic function of effecting a diagnosis as to failure of the flowmeters to thereby enable to prevent fluctuations in the air-fuel ratio of an air-fuel mixture supplied to the engine to be caused by failure of one or more of the flowmeters.

To attain the above object, the present invention provides an evaporative fuel-purging control system for an internal combustion engine having a fuel tank and an intake passage, the evaporative fuel-purging control system including a canister for adsorbing evaporative fuel generated from the fuel tank, and a purging passage connecting between the canister and the intake passage for purging a mixture of the evaporative fuel and air therethrough into the intake passage.

The evaporative fuel-purging control system according to the invention is characterized by comprising:

a plurality of flowmeters arranged in the purging passage for measuring a flow rate of the mixture being purged through the purging passage into the intake passage, the flowmeters having different output characteristics relative to change in concentration of evaporative fuel in the mixture from each other;

purging parameter detecting means for detecting at least one of the concentration of evaporative fuel in the mixture and a volumetric flow rate of the mixture, based upon outputs from the flowmeters;

comparing means for comparing values of the outputs from the flowmeters with each other; and failure detecting means for detecting failure of at least one of the flowmeters, based upon an output from the comparing means.

Preferably, the flowmeters comprise at least one mass flowmeter and at least one differential pressure type flowmeter.

In a preferred embodiment, the comparing means detects a difference between values of the outputs from the flowmeters, and the failure detecting means determines whether or not the detected difference falls within a predetermined range.

In another preferred embodiment, the comparing means detects a ratio between values of the outputs from the flowmeters, and the failure detecting means determines whether or not the detected ratio falls within a predetermined range.

The above and other objects, features, and advantages of the invention will be more apparent from the ensuring detailed description taken in conjunction with the accompanying drawings.

DETAILED DESCRIPTION

The invention will now be described in detail with reference to the drawings showing embodiments thereof.

Figure 1:
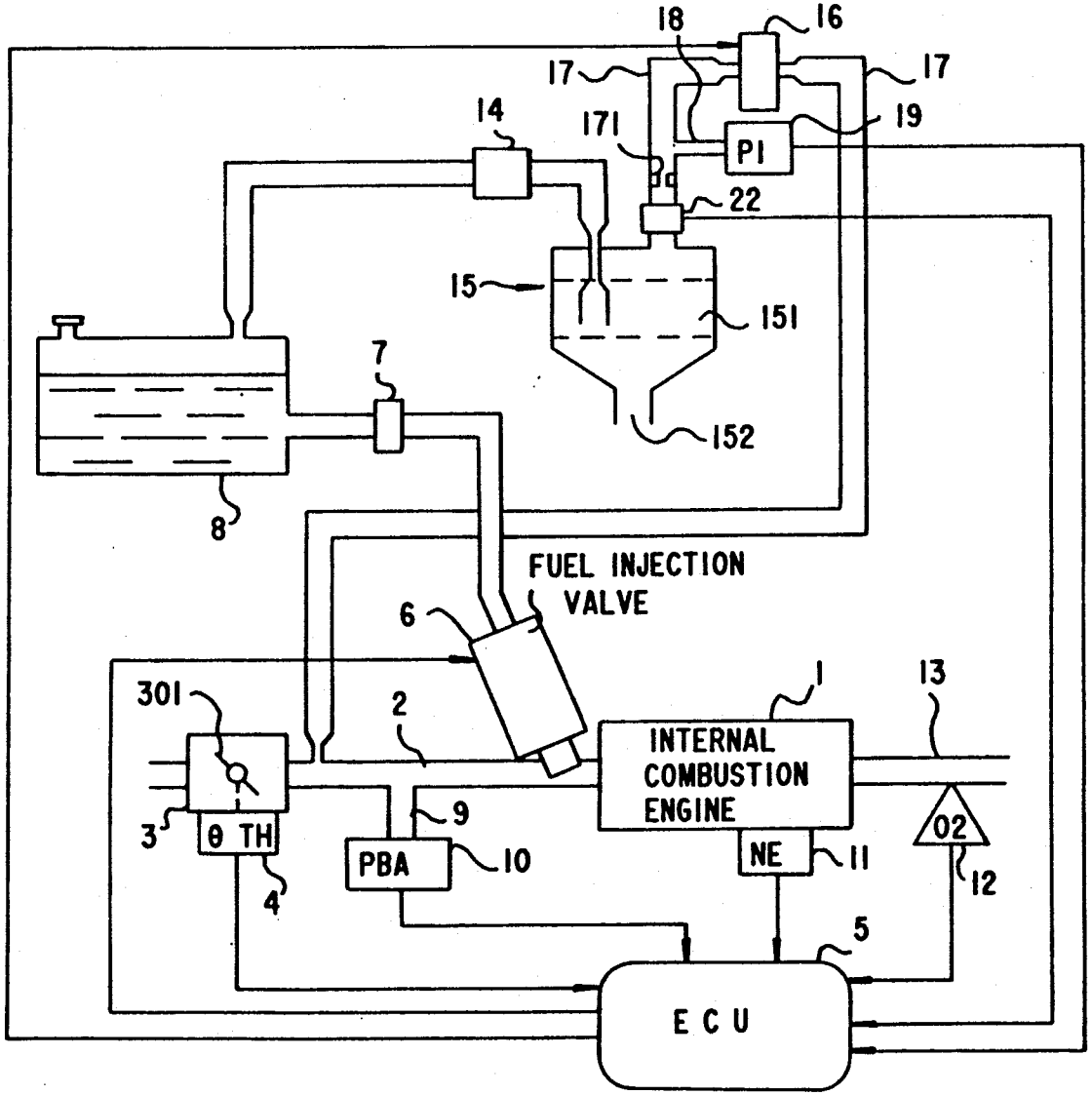
FIG. 1 is a block diagram showing the whole arrangement of a fuel supply control system for use in an internal combustion engine, including an evaporative fuel-purging control system according to an embodiment of the invention.

Referring first to FIG. 1, there is illustrated the whole arrangement of a fuel supply control system of an internal combustion engine, including an evaporative fuel-purging control system according to an embodiment of the invention. In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for generating an electric signal indicative of the sensed throttle valve opening and supplying same to an electronic control unit (hereinafter called "the ECU") 5. The ECU 5 forms part of purging parameter detecting means, comparing means, and fault detecting means.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of predetermined crank angles whenever the crankshaft rotates through 180 degrees, the pulse being supplied to the ECU 5.

An $O_2$ sensor 12 as an exhaust gas ingredient concentration sensor is mounted in an exhaust pipe 13 connected to the cylinder block of the engine 1, for sensing the concentration of oxygen present in exhaust gases emitted from the engine 1 and supplying an electric signal indicative of the sensed value of the oxygen concentration to the ECU 5.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve 16 in the form of a linear control valve which has a solenoid, not shown, for driving a valve element thereof, not shown. The solenoid of the purge control valve 16 is connected to the ECU 5 and controlled by a signal supplied therefrom to change the valve opening linearly. According to this evaporative emission control system, evaporative fuel or fuel vapor (hereinafter merely referred to as "evaporative fuel") generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at the flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evaporative fuel generated within the fuel tank 8 is prevented from being emitted into the atmosphere.

A restriction 171 is formed in a portion of the purging passage 17 at a location between the canister 15 and the purge control valve 16. Further, a pressure gauge 19 is connected via a conduit 18 to the purging passage 17 at a location between the restriction 171 and the purge control valve 16. The pressure gauge 19 and the restriction 171 cooperate to form a differential pressure type flowmeter. The pressure gauge 19 is formed by an atmospheric pressure-based differential pressure gauge which detects relative pressure P1 within the purging passage 17 to atmospheric pressure and supplies a signal indicative of the sensed relative pressure P1 to the ECU 5. The differential pressure type flowmeter is also formed by the ECU 5 which calculates a volumetric flow rate QP1 of a mixture of evaporative fuel and air passing through the restriction 171 (hereinafter referred to as "the purging flow rate"), based on the area of the restriction 171 and a value of the relative pressure P1 detected by the pressure gauge 19.

Further, a hot wire type flowmeter (mass flowmeter) 22 is arranged across the conduit line 17 at a location between the canister 15 and the purge control valve 16, which detects the flow rate of a mixture of evaporative fuel and air flowing in the conduct line 17 (purging flow rate) and supplies a signal indicative of the detected value of the purging flow rate to the ECU 5. The mass flowmeter 20 is a hot wire type which utilizes the nature of a platinum wire that when the platinum wire is heated by electric current applied thereto and at the same time exposed to a flow of gas, the platinum wire loses its heat to decrease in temperature so that its electric resistance decreases. Alternatively, it may be a thermo type comprising a thermistor of which the electric resistance varies due to self-heating by electric current applied thereto or a change in the ambient temperature. Both the types of mass flowmeter detect variation in the concentration of evaporative fuel through variation in the electric resistance thereof.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes programs for calculating control parameters for determining the valve opening of the purge control valve 16, referred to hereinafter, etc., memory means storing a Ti map, referred to hereinafter, and the programs executed by the CPU and for storing results of calculations therefrom, etc., and an output circuit which outputs driving signals to the fuel injection valves 6 and the purge control valve 16.

The CPU operates in response to the above-mentioned engine parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 6 are to be opened, by the use of the following equation (1) in synchronism with inputting of TDC signal pulses to the ECU 5:

$$TOUT = Ti \times KO_2 \times K1 + K2 \quad (1)$$

where Ti represents a basic value of the fuel injection period TOUT of the fuel injection valves 6, which is read from the Ti map in accordance with the engine rotational speed NE and the intake pipe absolute pressure PBA.

$KO_2$ represents an air-fuel ratio correction coefficient whose value is determined in response to the oxygen concentration in the exhaust gases detected by the $O_2$ sensor 12, during feedback control, while it is set to respective predetermined appropriate values while the engine is in predetermined operating regions (the open-loop control regions) other than the feedback control region.

K1 and K2 represent other correction coefficients and correction variables, respectively, which are calculated based on various engine parameter signals to such values as to optimize operating characteristics of the engine such as fuel consumption and accelerability depending on operating conditions of the engine.

The CPU supplies, through the output circuit, the fuel injection valves 6 with driving signals corresponding to the calculated fuel injection period TOUT determined as above, over which the fuel injection valves 6 are opened.

The CPU further controls the valve opening of the purge control valve 16 such that a flow rate VQ of evaporative fuel in the mixture flowing in the purging conduit line 17 (hereinafter referred to as "the vapor flow rate") becomes equal to a desired value.

The vapor flow rate VQ is calculated from an output value QS indicated by the differential pressure type flowmeter formed of the pressure gauge 19 and the restriction 171 and an output value QH indicated by the hot-wire type flowmeter 22. This is based on the ground that as the vapor concentration in the mixture flowing in the purging passage 17 varies, the QS and QH values vary even if the purging flow rate QP1 remains constant. Not only the vapor flow rate VQ but also the vapor concentration $\beta$ and the purging flow rate QP1 can be determined from the QS and QH values from the two types of flowmeters 19, 171; 22 which have different output characteristics from each other as well as relative to change in the vapor concentration $\beta$.

Details of these parameters VQ, $\beta$, and QP1 are disclosed in Japanese Patent Application No. 3-80726 assigned to the assignee of the present invention, referred to hereinbefore.

Figure 2:
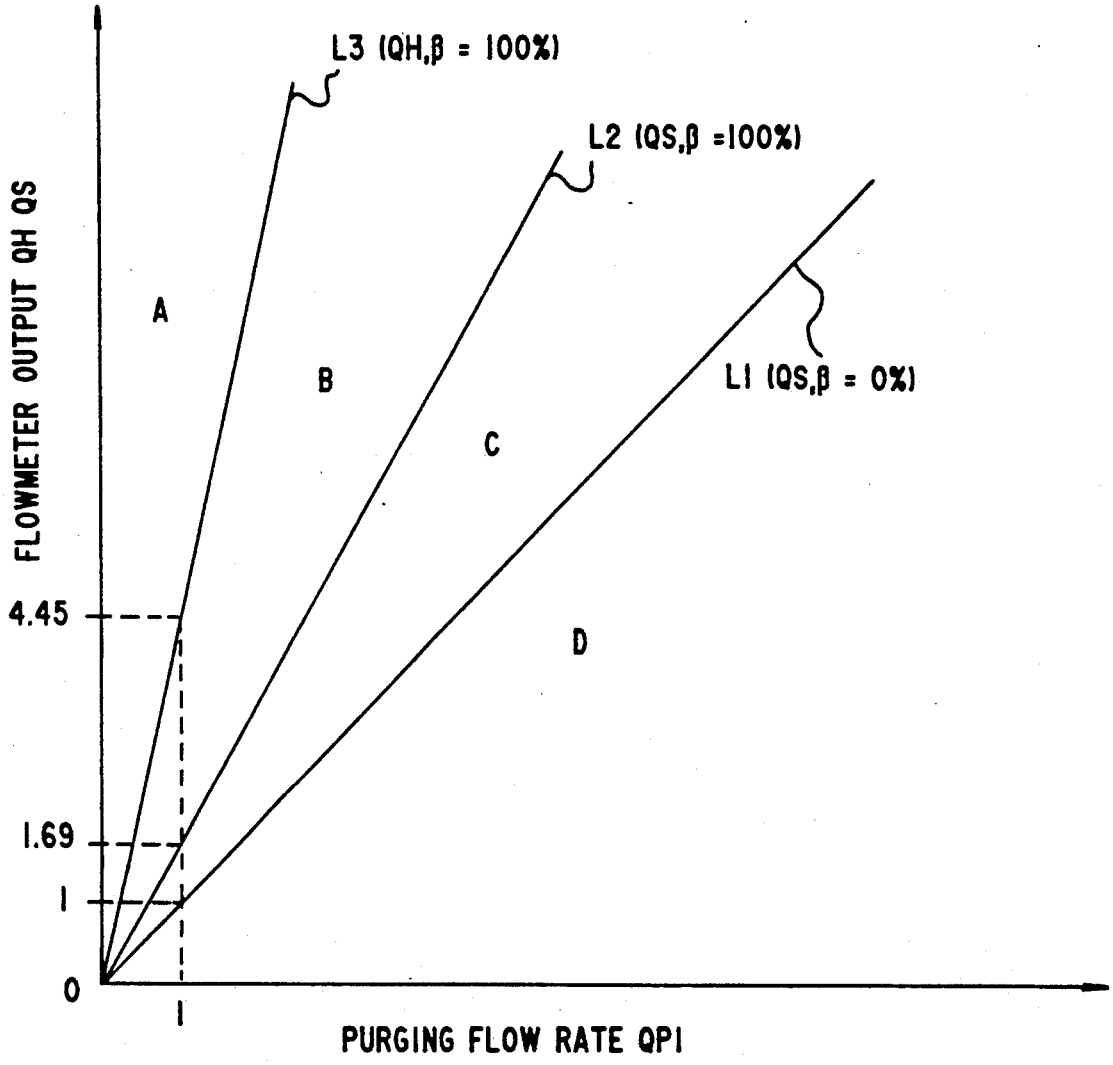
FIG. 2 is a graph showing the relationship between a purging flow rate (QP1) and outputs (QH, QS) from flowmeters.

In the present embodiment, the CPU of the ECU 5 carries out a diagnosis as to whether there is abnormality in one or both of the differential pressure type flowmeter 19, 171 and the hot wire type flowmeter 22, in the following manner:

FIG. 2 shows the relationship between the purging flow rate QP1 and output values QH, QS from the flowmeters. In the figure, the line L1 represents the above relationship assumed when the vapor concentration $\beta$ is equal to 0%, according to which the relationship of QS=QH=QP1 holds. The lines L2 and L3 represent, respectively, the relationship between QP1 and QS and one between QP1 and QH, which are assumed when $\beta=100\%$, according to which QS=1.69×QP1 and QH=4.45×QP1 hold. If both the two flowmeters are normally functioning, the value QS should fall within a region C in the figure, and the value QH within regions B and C, irrespective of the vapor concentration $\beta$. Therefore, if one or both of the value QS and the value QH fall outside the respective regions C, and B and C, it can be judged that one or both of the flowmeters are faulty.

Figure 3:
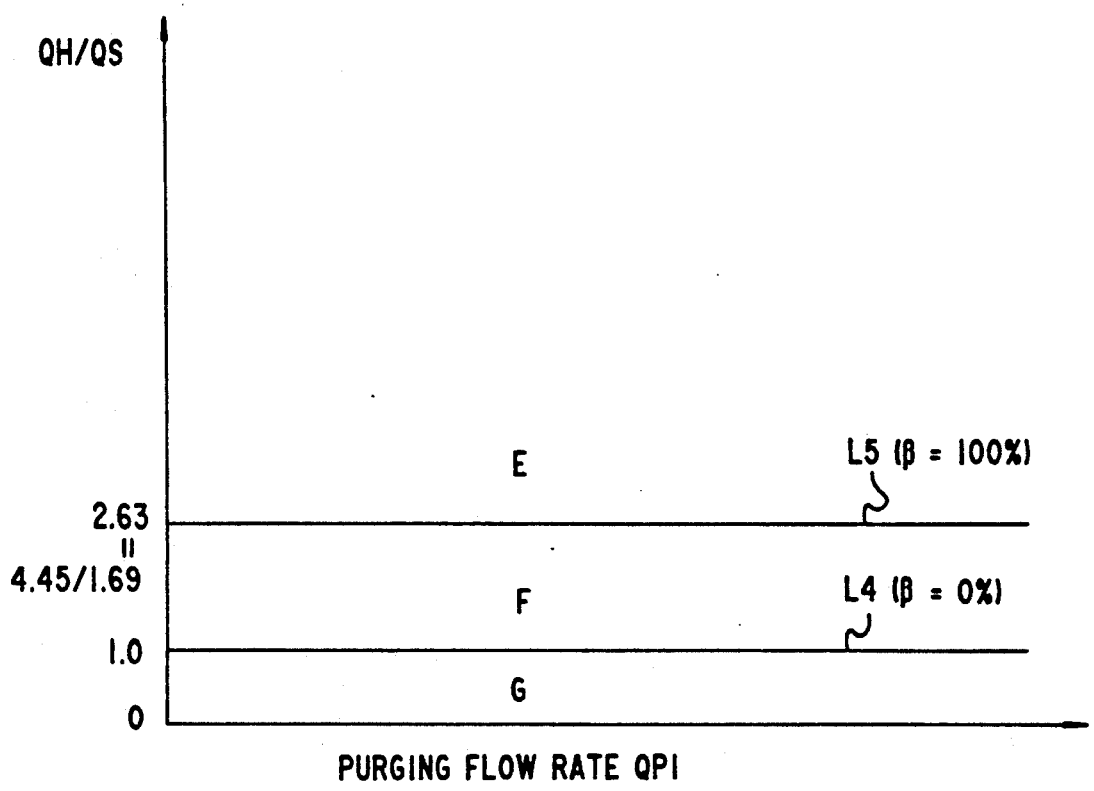
FIG. 3 is a graph showing the relationship between the purging flow rate (QP1) and a ratio between outputs from the flowmeters.

FIG. 3 shows the relationship between an output ratio QH/QS and the purging flow rate QP1, which is obtained from the relationship of FIG. 2. The output ratio QH/QS, i.e. the ratio of the value QH to the value QS, remains constant even if the purging flow rate QP1 varies. As shown in FIG. 3, when $\beta=0\%$, QH/QS=1.0, as indicated by the line L4, while when $\beta=100\%$, QH/QS=2.63 (=4.45/1.63), as indicated by the line L5. Therefore, if the two flowmeters are both normally functioning, the value QH/QS should fall within a region F in the figure. Thus, if the value QH/QS falls outside the region F, it can be judged that at least one of the flowmeters is faulty.

Figure 4:
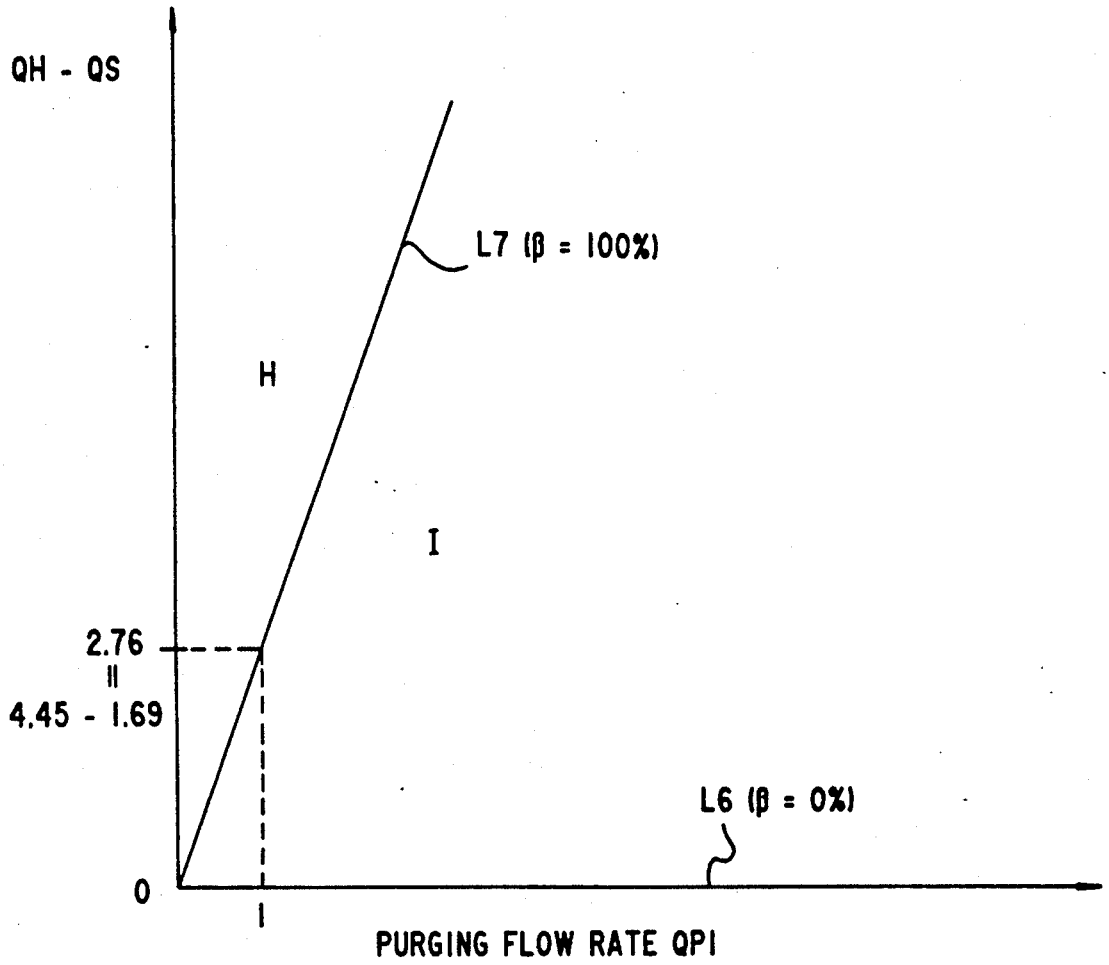
FIG. 4 is a graph showing the relationship between the purging flow rate (QP1) and a difference between outputs from the flowmeters.

FIG. 4 shows the relationship between an output difference QH−QS and the purging flow rate QP1, which is obtained from the relationship of FIG. 2. As shown in the figure, when $\beta=0\%$, the output difference QH−QS between output values QH, QS of the two flowmeters remains constant even if the purging flow rate QP1 varies, i.e. it is equal to 0, as indicated by the line L6, whereas when $\beta=100\%$, QH=QS=2.76×QP1, as indicated by the line L7. Thus, if the two flowmeters are both normally functioning, the output difference QH−QS should fall within a region I in the figure, and therefore the value QH−QS falls outside the region I, it can be judged that at least one of the flowmeters is faulty.

Figure 5:
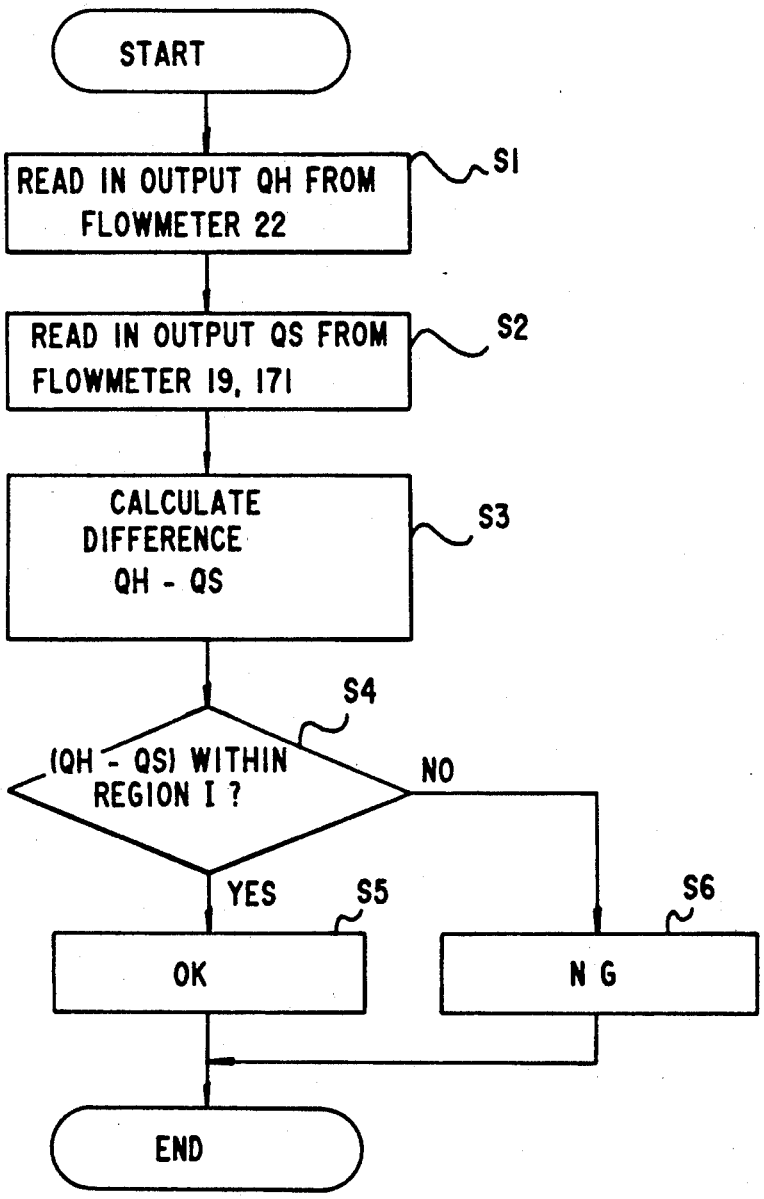
FIG. 5 is a flowchart of a program for effecting a fault diagnosis of the flowmeters.

FIG. 5 shows a program which is executed by the CPU of the ECU 5 for carrying out the above described fault diagnosis.

First, at steps S1 and S2, detected output values QH and QS from the hot wire type flowmeter 22 and the differential pressure type flowmeter 19, 171 are read in, followed by calculating the difference QH−QS between the read output values QH, QS at a step S3. At the following step S4, it is determined whether or not the calculated difference (QH−QS) falls within a normal range, i.e. within the region I in FIG. 4. If the answer is affirmative (Yes), it is judged that neither of the flowmeters is faulty (OK) (step S5), whereas if the answer is negative (No), it is judged that at least one of the flowmeters is faulty (NG) (step S6).

The determination of the step S4 as to whether or not the difference (QH−QS) falls within the region I is made in relation to the detected purging flow rate QP1.

Figure 6:
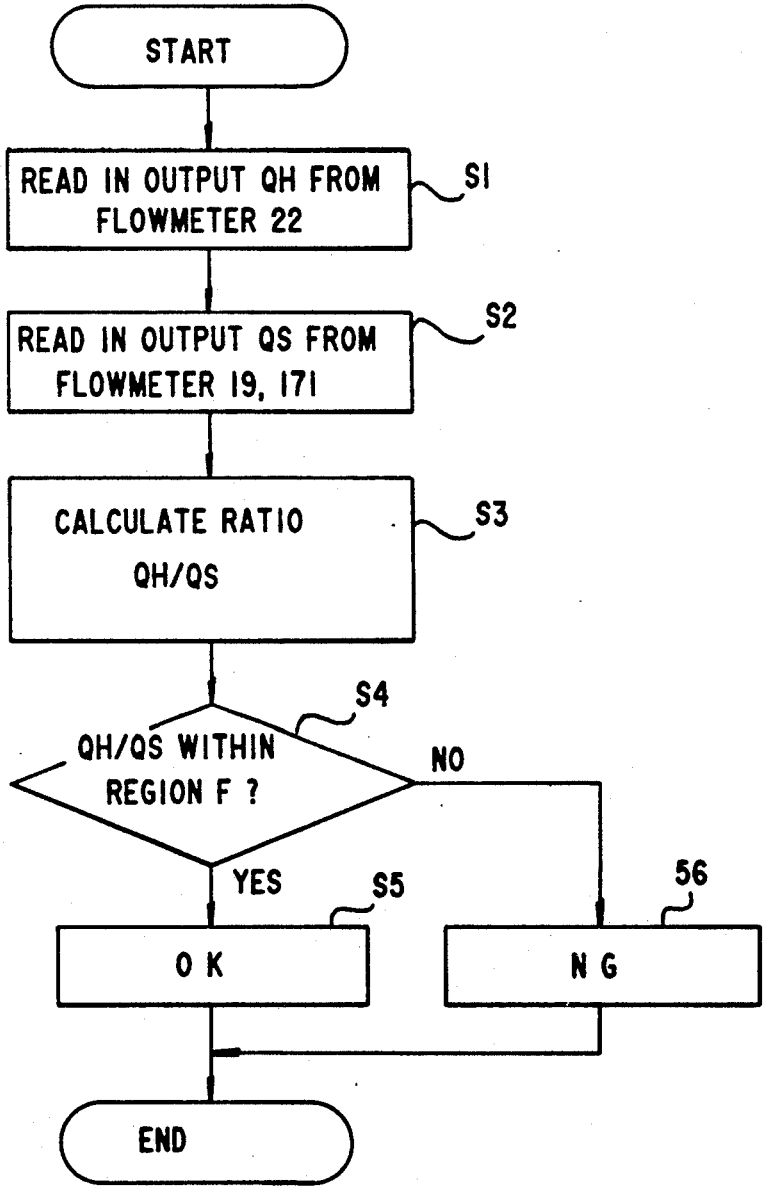
FIG. 6 is a flowchart of another program for effecting a fault diagnosis of the flowmeters.

FIG. 6 shows a program executed by the CPU for carrying out a fault diagnosis of the flowmeters, based upon the output ratio QH/QS. This program is different from the FIG. 5 program only in steps S3*a* and S4*a* thereof, while the other steps are identical with respective corresponding steps in FIG. 5, and description thereof is therefore omitted.

At the step S3*a* in FIG. 6, the output ratio QH/QS is calculated, and then at the step S4*a* it is determined whether or not the calculated value QH/QS falls within a normal range, i.e. within the region F in FIG. 3. If the value QH/QS falls within the region F, it is judged at the step S5 that there is no fault in either of the flowmeters (OK), while if the value QH/QS falls outside the region F, it is judged at the step S6 that at least one of the flowmeters is faulty (NG).

When it is judged that there is a fault in any of the flowmeters as a result of execution of the program of FIG. 5 or FIG. 6, a failsafe action is taken. For example, the valve opening of the purge control valve 16 is held at such a fixed value that evaporative fuel is purged in an amount not badly affecting the operation of the engine, over all possible operating conditions thereof. Alternatively, the purge control valve 16 may be fully closed to stop purging. Further alternatively, the valve opening of the purge control valve 16 may be held at a fixed value corresponding to an operating condition in which the engine is operating, which is selected from among a plurality of fixed values corresponding, respectively to as many possible operating conditions previously set in accordance with engine operating parameters such as the engine rotational speed NE and the intake pipe absolute pressure PBA.

When the failsafe action is taken in any of the above-mentioned manners, the air-fuel ratio correction coefficient $KO_2$ is corrected in response to the valve opening of the purge control valve 16.

In the above described manner, according to this embodiment, failure of at least one of the two flowmeters is detected, and when the failure is detected, an appropriate failsafe action is performed, to thereby prevent fluctuations in the air-fuel ratio of a mixture supplied to the engine due to failure of one or both the flowmeters.

Figure 7:
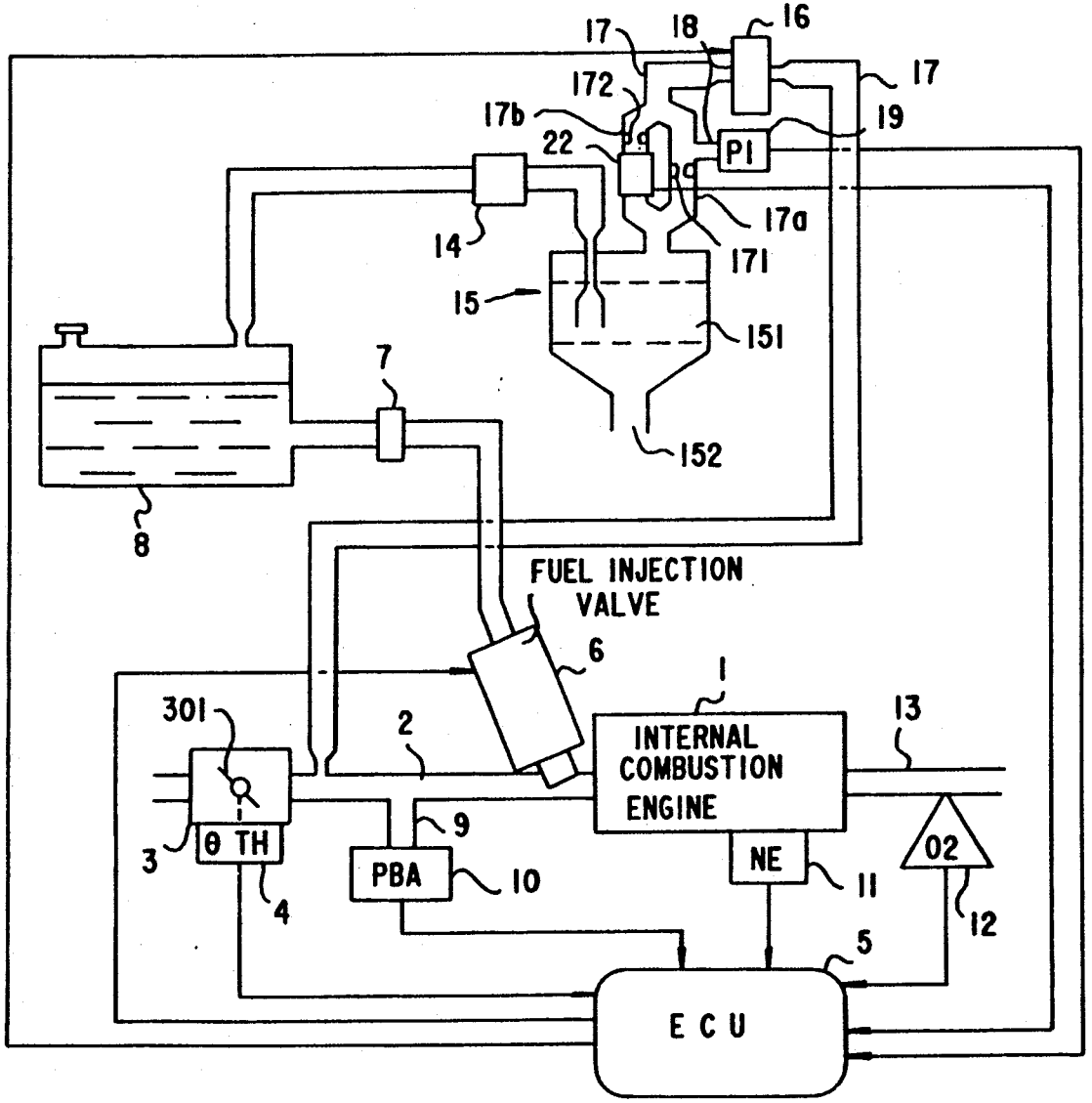
FIG. 7 is a block diagram similar to FIG. 1, showing another embodiment of the invention.

Although in the above described embodiment the differential pressure type flowmeter 19, 171 and the hot wire type flowmeter 22 are connected in series with each other, they may be connected in parallel with each other, for example, in an arrangement shown in FIG. 7. In the figure, part of the purging conduit line 17 is formed by two conduit lines 17*a*, 17*b* connected in parallel with each other and having restrictions 171, 172 formed therein, respectively. The pressure gauge 19 is connected to the conduit line 17*a*, while the hot wire type flowmeter 22 is arranged across the other conduit line 17*b*.

What is claimed is:

1. In an evaporative fuel-purging control system for an internal combustion engine having a fuel tank and an intake passage, said evaporative fuel-purging control system including a canister for adsorbing evaporative fuel generated from said fuel tank, and a purging passage connecting between said canister and said intake passage for purging a mixture of said evaporative fuel and air therethrough into said intake passage, the improvement comprising:

a plurality of flowmeters arranged in said purging passage for measuring a flow rate of said mixture being purged through said purging passage into said intake passage, said flowmeters having different output characteristics relative to change in concentration of evaporative fuel in said mixture from each other;

purging parameter detecting means for detecting at least one of said concentration of evaporative fuel in said mixture and a volumetric flow rate of said mixture, based upon outputs from said flowmeters;

comparing means for comparing values of said outputs from said flowmeters with each other; and failure detecting means for detecting failure of at least one of said flowmeters, based upon an output from said comparing means.

2. An evaporative fuel-purging control system as claimed in claim 1, wherein said flowmeters comprise at least one mass flowmeter and at least one differential pressure type flowmeter.

3. An evaporative fuel-purging control system as claimed in claim 1 or 2, wherein said comparing means detects a difference between values of said outputs from said flowmeters, and said failure detecting means determines whether or not the detected difference falls within a predetermined range.

4. An evaporative fuel-purging control system as claimed in claim 1 or 2, wherein said comparing means detects a ratio between values of said outputs from said flowmeters, and said failure detecting means determines whether or not the detected ratio falls within a predetermined range.

5. An evaporative fuel-purging control system as claimed in claim 1 or 2, wherein said flowmeters are arranged in said purging passage, in series with each other.

6. An evaporative fuel-purging control system as claimed in claim 1 or 2, wherein said flowmeters are arranged in said purging passage, in parallel with each other.

7. An evaporative fuel-purging control system as claimed in claim 3, wherein said predetermined range is determined based upon the detected concentration of evaporative fuel in said mixture and the detected volumetric flow rate of said mixture.

8. An evaporative fuel-purging control system as claimed in claim 4, wherein said predetermined range is determined based upon the detected concentration of evaporative fuel in said mixture.

* * * * *